US008418264B2

(12) United States Patent
Alexander

(10) Patent No.: US 8,418,264 B2
(45) Date of Patent: Apr. 16, 2013

(54) PROTECTIVE CAPE

(75) Inventor: James Alexander, Chappaqua, NY (US)

(73) Assignee: Capemakers LLC, Chappaqua, NY (US)

( * ) Notice: Subject to any disclaimer, the term of this patent is extended or adjusted under 35 U.S.C. 154(b) by 239 days.

(21) Appl. No.: 12/778,844

(22) Filed: May 12, 2010

(65) Prior Publication Data

US 2010/0287677 A1 Nov. 18, 2010

Related U.S. Application Data

(60) Provisional application No. 61/216,272, filed on May 15, 2009.

(51) Int. Cl.
*A41D 13/04* (2006.01)

(52) U.S. Cl.
USPC ..... 2/50

(58) Field of Classification Search ..... 2/50, 88, 2/48, 51, 87, 84, 94, 247, 249, 250, 69, 69.5, 2/115, 85, 93, 108
See application file for complete search history.

(56) References Cited

U.S. PATENT DOCUMENTS

| | | | | | |
|---|---|---|---|---|---|
| 913,694 | A | * | 3/1909 | Carpenter | 2/88 |
| 2,540,448 | A | * | 2/1951 | Karow | 2/87 |
| 2,898,599 | A | * | 8/1959 | Seckendorf | 2/88 |
| 2,932,034 | A | * | 4/1960 | Carroll | 2/88 |
| 3,055,133 | A | * | 9/1962 | Anderson | 40/586 |
| 4,202,053 | A | * | 5/1980 | Bell | 2/84 |
| 4,834,688 | A | * | 5/1989 | Jones | 446/28 |
| D405,940 | S | * | 2/1999 | Payne | D2/861 |
| D454,677 | S | * | 3/2002 | Peters | D2/825 |
| 7,364,491 | B2 | * | 4/2008 | Updyke | 450/89 |
| 7,992,225 | B2 | * | 8/2011 | Demus | 2/247 |
| 2006/0075537 | A1 | * | 4/2006 | Tsai | 2/69 |
| 2007/0107111 | A1 | * | 5/2007 | Passman | 2/247 |
| 2009/0094725 | A1 | * | 4/2009 | Smith et al. | 2/69 |
| 2010/0175161 | A1 | * | 7/2010 | Jarboe | 2/69 |
| 2010/0299800 | A1 | * | 12/2010 | Jackson, Jr. | 2/69 |

FOREIGN PATENT DOCUMENTS

| | | | |
|---|---|---|---|
| CN | 201468054 | U * | 5/2010 |
| CN | 202135724 | U * | 2/2012 |

* cited by examiner

*Primary Examiner* — Amy Vanatta

(74) *Attorney, Agent, or Firm* — Edwards Wildman Palmer LLP; Scott D. Wofsy; Christopher J. Capelli

(57) ABSTRACT

The present invention relates to a cape for protecting a user from containments. The cape includes a neck portion adapted to be secured to a neck of the user and a main body portion having opposing front and rear portions extending from the neck portion adapted to cover the user. A translucent window assembly is provided on a front portion of the cape for providing visual access to a user's personal item disposed behind a rear portion of the cape.

11 Claims, 2 Drawing Sheets

PROTECTIVE CAPE

FIELD OF THE INVENTION

The present invention relates to protective coverings, and more particularly to protective capes adapted for hair salon patrons and employees.

BACKGROUND OF THE INVENTION

There are many types of protective coverings and garments available to protect one's clothes from the damaging effects of dirt, chemicals, and moisture. For instance, in hair care establishments, these garments are most commonly in the form of a cape or apron.

Such protective apparel is worn by both hairdressers and clients as protection against chemicals and shampoos while shampooing, treating, cutting, or dying a client's hair. For barber shop or salon clients, which include young children to older adults, the cape also tends to keep irritating hair clippings away from clothes and skin. Traditionally, the capes are fabricated from a sheet of cloth fabric or synthetic material such as nylon or plastic, which is draped over the client's shoulders and tied or clasped together in the front or back of the client's neck.

Although prior art capes utilized in salons provide adequate protection, in today's environment of reliance upon personal electronic devices (e.g., a Personal Digital Assistant (PDA), a cell phone, a smart phone such as iPhone® or Blackberry®, an electronic reading device such as the Amazon Kindle® or Apple iPad®, a music playing device such as an iPod® or other MP3 player, or game device such as the Nintendo DS®), there is currently a drawback to using such prior art capes.

For example, a user of a cape is prevented from gaining access to their personal electronic device, which at times is a necessity. For instance, a user typically retains their cell phone around their waist portion (e.g., secured to a belt) or in a pocket. Thus, when a user is wearing a protective cape and is required to gain access to their cell phone for an important call or message (e.g., to determine whom is trying to reach them, which may be an emergency situation), the user is forced to manipulate or remove the protective cape which interrupts the ongoing procedure. Further, a protective cape user who is having a procedure performed upon them may make sudden movements to gain visual access to their personal electronic device thus creating a potentially dangerous situation wherein the user may be exposing themselves to dangerous chemicals by manipulating the cape or to harmful exposure to a pair of hair shears or razor product currently being used in the procedure through sudden body movements.

It is also noted if a protective cape user was permitted access through the protective cape to their personal electronic device (e.g., for communication with others, reading, playing games, listening to music, etc.), the user would be provided a more pleasant experience during the duration of a procedure being performed upon them as in a hair salon. For hair care establishments serving younger, more active clients, additional productivity benefits would be derived by focusing attention on an electronic device thereby creating a sedentary client.

The present invention seeks to solve these deficiencies.

SUMMARY OF THE INVENTION

The present invention relates to a cape for protecting a user from containments. The cape includes a neck portion adapted to be secured to a neck of the user and a main body portion having opposing front and rear portions extending from the neck portion adapted to cover the user with each said front and rear portion having opposing front and rear panels. A translucent window assembly is provided on the front portion of the cape for providing visual access to a user's personal item (e.g., portable electronic devices such as a cell phone, PDA, mp3 player, gaming device or the like) disposed behind the rear panel of the front portion of the cape.

The translucent window assembly may further include a pouch assembly for retaining the user's personal item while providing visual access thereto. The pouch assembly preferably includes a rear panel member secured to the rear panel of the cape having an open end thereof configured to receive the user's personal item in the pouch assembly. Additionally, a headphone cutout portion may be provided in close proximity to the translucent window assembly on the front portion of the cape configured to receive a headphone cord extending from the user's personal item disposed behind the rear panel of the cape.

BRIEF DESCRIPTION OF THE DRAWINGS

The objects and features of the invention may be understood with reference to the following detailed description of an illustrative embodiment of the present invention taken together in conjunction with the accompanying drawing in which.

DETAILED DESCRIPTION

Figure 1:
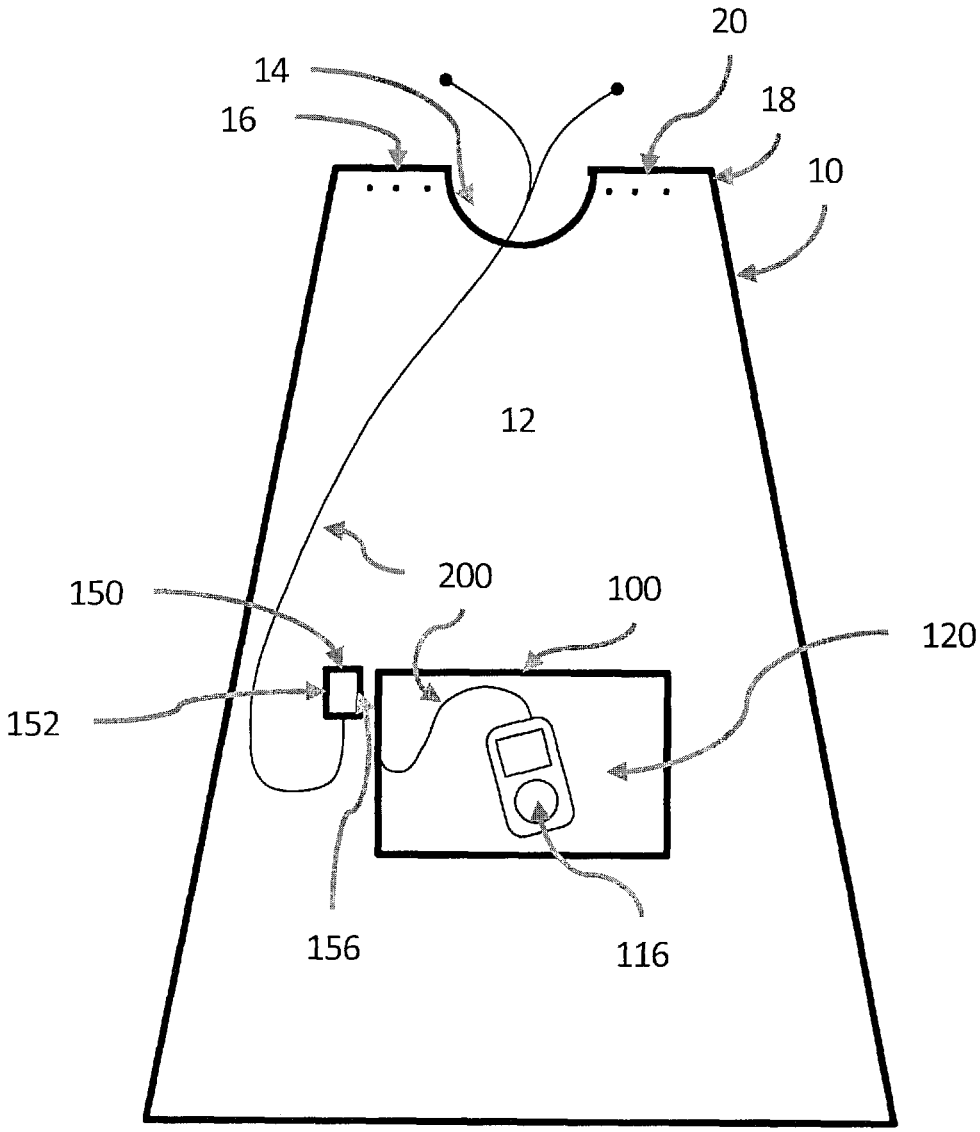
FIG. 1 illustrates a planar front view of the cape according to the present invention.

Turning now descriptively to the drawings, in which similar reference characters denote similar elements throughout the several views, FIG. 1 depicts an illustrated embodiment of the cape of the present invention, designated generally by reference numeral 10.

When used in a hair salon, the present invention is a cape 10 designed to protect the user's clothing and skin from coming in contact with undesirable materials such as shampoo, conditioner, hair dye, or cut hair. The cape may be constructed of a liquid impermeable material such as nylon, plastic coated fabric, liquid resistant paper material or any other suitable material and may be designed for either one-time (disposable) or long-term use. While reference is made for use in a hair salon, it is to be understood that use of the present invention cape is not to be understood to be limited to such a hair salon as it may be used for any purpose in which a user desires to be shielded from airborne containments (e.g., painting, chemical solvent dispersion, moisture (rain) and the like). For instance, the present invention cape 10 as described below may be configured as a rain cape including a hood member for shielding a user's head from rain, which rain cape may also include arm slits or slots for permitting a user's arms to extend through the cape 10 when the rain cape is fitted to the user.

Figure 2:
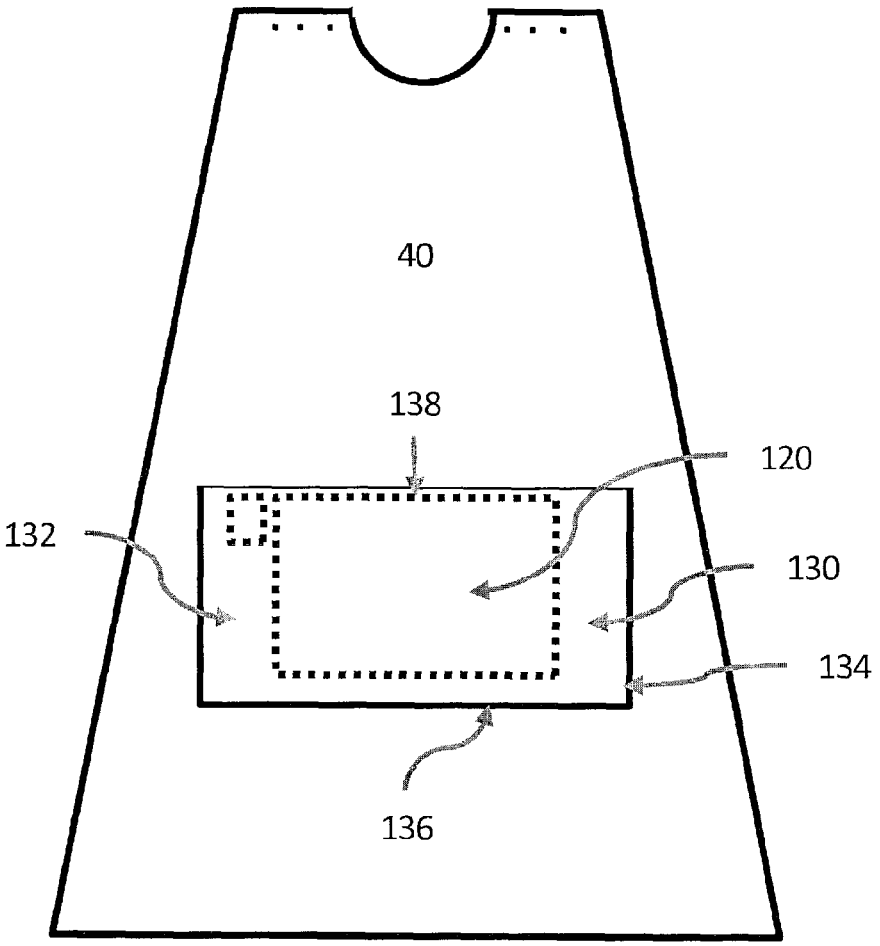
FIG. 2 illustrates a cutaway view of the cape of FIG. 1 depicting the rear panel of the front portion of the cape.

As illustrated in FIGS. 1 and 2, the present invention cape 10 preferably comprises a sheet or material fabricated such as described above, with an opening 14 located at the top center portion for filling over the user's head. The cape 10 is typically of a triangular or rectangular shape although other shapes are possible. A slit or slot 16 preferably extends between neck opening 14 and a side edge 18 of cape 10, with the slit 16 being formed or defined by facing or opposing edges 20. Typically, complementary fasteners 22 (e.g., buttons, hooks or the like) or fastener strips (e.g., VELCRO®) are secured to the opposing edges 20 so as to permit the cape 10 to be closed about the neck of a user so that the cape 10 stays in place.

Preferably, the material used to form the cape is precut to a convenient size and shape so that it covers the whole of the user's body when worn. As mentioned above, the material for the cape 10 may be triangular as shown in FIG. 1 or any other shape that will provide complete coverage of the user's body with the option of being large enough to also cover part or all of the user's legs. Head opening 14 is adjustable in some manner so that it may be fitted to each specific user, resulting in a snug and comfortable fit around the user's neck. The design of the cape 10 allows room for wording, logos, drawings, etc. that can be used as advertising space, identification markings or any other purpose.

As depicted in FIG. 1, the front portion 12 of cape 10 is fitted with a window assembly 100 for providing visual access and/or temporarily storing a personal electronic device 110 or other personal items belonging to a user fitted with the cape 10 as described below. It is to be appreciated the personal electronic device 110 or other personal items may include a cellular phone, Personal Digital Assistant (PDA), electronic reading device, document, magazine, book or the like.

The window assembly 100 preferably includes a translucent panel 120 secured to a cutout portion formed in the front portion 12 of the cape. The translucent panel 120 may be constructed of a translucent plastic material designed for one-time (disposable) or long-term use. The translucent panel 120 is secured to the cutout portion through any known means of securing two materials to each other including sewing, adhesives, fastener assemblies (e.g., buttons, clasps, VELCRO®, etc.) or the like. It is to be appreciated the translucent panel 120 may be either permanently or detachably affixed about the cutout portion on the protective cape 10. The translucent panel 120 provides visual access to a personal electronic device or other items 110 while the user is fitted with the protective cape 10.

With reference to FIGS. 1 and 2, the window assembly 100 may additionally include a rear supporting panel 130 secured to the back 40 of the front portion 12 of cape 10. The rear supporting panel 130 may be formed of the same material comprising the cape 10 or translucent panel 120 and is dimensioned slightly larger than the aforesaid cutout portion formed on the front panel of cape 10 to which translucent panel 120 is secured thereto thereby forming a pouch pocket. Preferably, the opposing side edges 132, 134 and bottom edge 136 of rear supporting panel 130 are secured to the back 40 of the front portion 12 of cape 10 thorough any known adherence means (e.g., sewing, adhesive boding or the like) with the top edge 138 forming an opening to which dispose of and retrieve the aforesaid personal electronic device or other personal items 110 to and from the formed pouch pocket. The rear supporting panel 130 may additionally include a securing member, such as an elastic strap, for securing a personal electronic item or other personal item thereto so as to remain in a stationary position when retained in the pouch pocket formed by the rear supporting panel 130.

It is also to be appreciated that rear supporting panel 130 may be removably secured to the back 40 of the front portion 12 of cape 10 so as to be removable thereform. This is advantageous when a user does not require a pouch pocket assembly for gaining visual access to personal electronic device or other personal items 110 (e.g., when a cellular phone secured to a belt of a user). This can be achieved through any known means for providing such detachable engagement such as buttons, hooks fastener strips (e.g., VELCRO®) or the like.

Additionally, a small headphone cutout portion 150 may be provided adjacent the window assembly 100 for enabling headphones 200 to extend from a user's personal electronic device residing within the rear supporting panel 130 (when secured to the back of cape 10, as mentioned above) through the front portion 12 of cape 10 and to the user for operation thereof. A small protective panel 152 may be affixed atop the headphone cutout portion 150 forming an open bottom end 156 through which extends a headphone cord 200 so as to prevent containments from entering through the headphone cutout portion 150.

The foregoing description and the illustrative embodiments of the present invention have been described in detail in varying modifications and alternate embodiments. While a preferred embodiment of the present invention protective cape has been disclosed for illustrative purposes, those who are skilled in the art will appreciate that various modifications, additions and substitutions are possible, without departing from the scope and spirit of the invention as set forth in the accompanying drawings.

What is claimed is:

1. A cape for protecting a user, said cape comprising:

a main body portion defining a neck portion adapted to be secured to a neck of a said user, the main body portion having opposing front and rear portions; and a pouch assembly provided in the main body, the pouch assembly including:

a first cutout portion formed in the main body;

a second cutout portion formed in the main body, wherein the second cutout portion is formed adjacent the first cutout portion;

a rear panel member affixed to the rear portion of the main body such that the rear panel member covers both the first and second cutout portions and has an open edge portion free from the rear portion of the main body providing user access to a pouch formed between the rear panel member and the rear portion of the main body; and a translucent window panel affixed on the front portion of said main body such that the translucent window panel is sized to cover the first cutout portion and not the second cutout portion, the translucent window panel adapted for providing visual access to a user's personal item disposed in said pouch formed between the rear panel member and the rear portion of the main body.

2. A cape for protecting a user as recited in claim 1 wherein said first cutout portion is greater in size than said second cutout portion.

3. A cape for protecting a user as recited in claim 1 wherein said main body portion has a rectangular shape.

4. A cape for protecting a user as recited in claim 1, wherein said rear panel member is detachably affixed to said rear portion of said main body.

5. A cape for protecting a user as recited in claim 1, wherein said rear panel member includes a supporting assembly for detachably securing a said user's personal item to said rear panel member.

6. A cape for protecting a user as recited in claim 1 further including a protective panel affixed over said second cutout portion on said front portion of said main body portion to form an opening to receive a headphone cord extending through said second cutout portion.

7. A cape for protecting a user as recited in claim 1 wherein said user's personal item is an electronic device.

8. A cape for protecting a user as recited in claim 7 wherein said electronic device is selected from the group consisting of a cellular phone, a Personal Digital Assistant (PDA), electronic reading device, smart phone, an audio player, or a game device.

9. A cape for protecting a user as recited in claim 1 wherein said cape is configured to protect a user from moisture.

10. A cape for protecting a user as recited in claim 1 wherein said cape is configured to protect a user from exposure to containments during a hair salon procedure.

11. A cape for protecting a user as recited in claim 2, wherein said translucent panel member is detachably affixed about said first cutout portion.

* * * * *